US005353620A

United States Patent [19]

Olsen et al.

[11] Patent Number: 5,353,620

[45] Date of Patent: Oct. 11, 1994

[54] PORTABLE SHEET BENDING BRAKE

[75] Inventors: David B. Olsen; Douglas J. Chubb, both of Dearborn; Arthur B. Chubb, Romulus, all of Mich.

[73] Assignee: Tapco Products Company, Inc., Plymouth, Mich.

[21] Appl. No.: 111,978

[22] Filed: Aug. 25, 1993

[51] Int. Cl.[5] ..... B21D 5/04

[52] U.S. Cl. ..... 72/319

[58] Field of Search ..... 72/319-321; 269/228, 201, 249

[56] References Cited

U.S. PATENT DOCUMENTS

| | | | |
|---|---|---|---|
| 2,988,122 | 6/1961 | Stevens | 269/228 |
| 3,147,791 | 9/1964 | Rauen | 72/319 |
| 3,161,223 | 12/1964 | Marsh . | |
| 3,481,174 | 12/1969 | Barnack . | |
| 3,482,427 | 12/1969 | Barnack . | |
| 3,559,444 | 2/1971 | Blazey et al. . | |
| 3,817,075 | 6/1974 | Marsh et al. . | |
| 4,237,716 | 12/1980 | Onisko | 72/319 |
| 4,321,817 | 3/1982 | Barnack . | |
| 4,416,104 | 11/1983 | Yamada | 269/228 |
| 4,557,132 | 12/1985 | Break | 72/319 |
| 4,671,094 | 6/1987 | Break | 72/319 |
| 4,766,757 | 8/1988 | Break | 72/319 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprises a frame having a fixed jaw and a movable jaw. The fixed jaw defines a clamping surface and the movable jaw has a clamping surface movable between workpiece clamping and non-clamping positions relative to the clamping surface on the fixed jaw. A bending member is hingedly connected to the fixed jaw. A handle is pivoted to the frame. A plurality of axially extensible links are provided. Each link is pivoted at one end to the handle and at the other end to the movable jaw such that in one position of the handle, the links move the movable jaw out of clamping position, and in another position of the handle, the movable jaw is in clamping position. Each link includes an upper block connected to the frame, a shaft extending from the upper block and rotatable therein and threaded into a lower block pivoted to the movable jaw. The shaft has a socket connection in the upper end thereof accessible through an opening in the upper block.

12 Claims, 6 Drawing Sheets

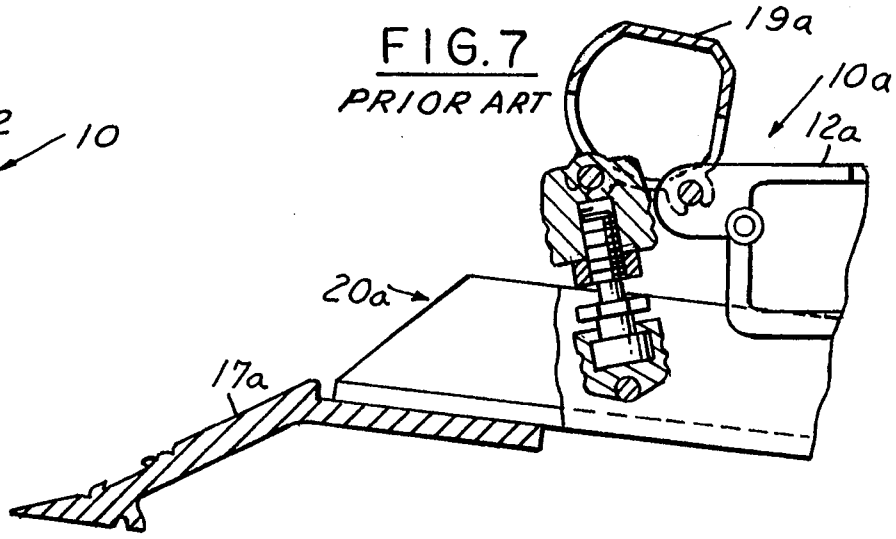
FIG. 7
PRIOR ART
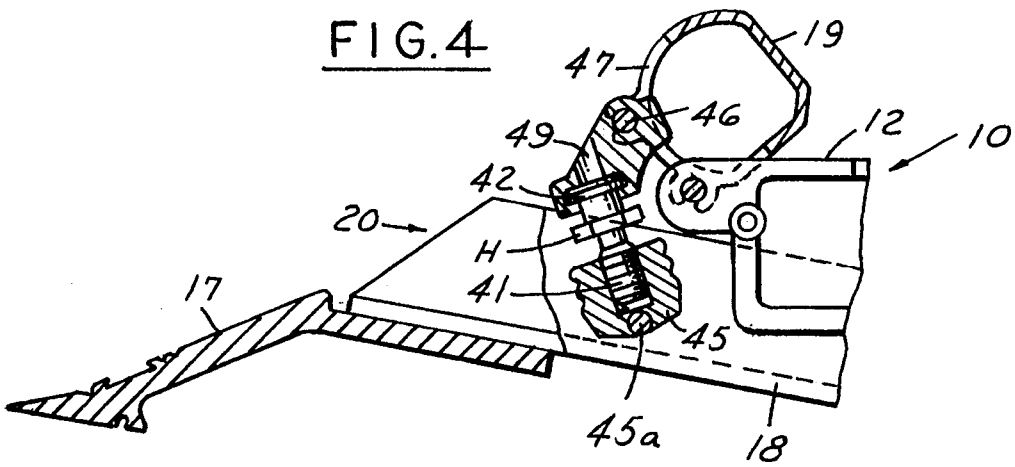
FIG. 4
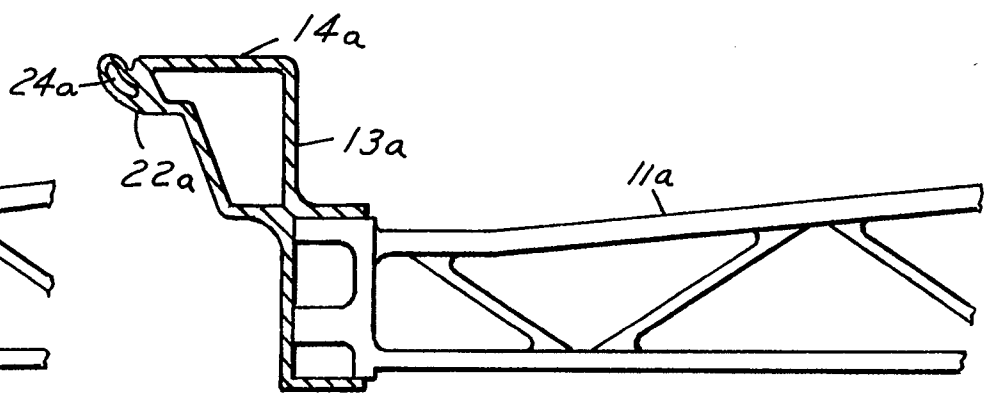
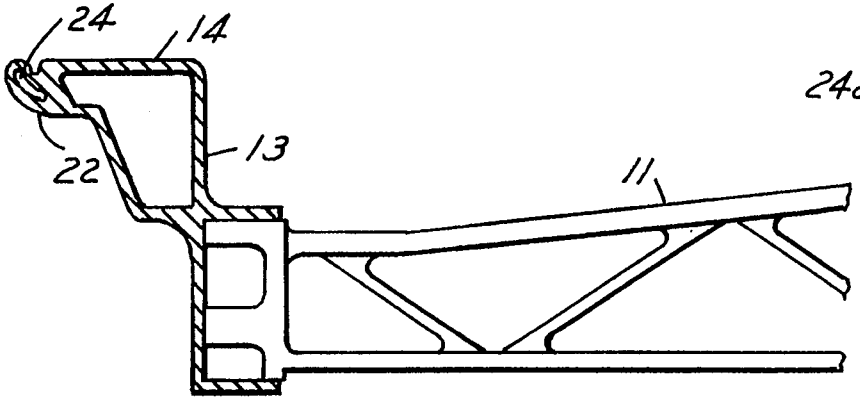

PORTABLE SHEET BENDING BRAKE

BACKGROUND AND SUMMARY OF THE INVENTION

In recent years, various structures have been provided to form a portable sheet bending brake for bending metal or plastic sheets such as are used in siding on homes and buildings. Typical patents comprise U.S. Pat. Nos. 3,161,223, 3,482,427, 3,559,444, 3,817,075 and 4,321,817.

Such brakes comprise a fixed member on which the sheet is clamped and a movable bending member for bending the sheet. A major problem with respect to such sheet bending brakes is the tendency of the bending member to move relative to the portion of the sheet being bent and thereby mar the surface of the sheet.

In U.S. Pat. No. 3,161,223, the tendency to mar the surface of the sheet material was minimized by having the intermeshing integral projections between the fixed member and bending member which extend longitudinally and define the hinge that connects the bending member with the fixed member having the clamping surface, positioned so that all portions of the projections do not extend above the plane of the surface of the members when the surfaces are substantially aligned.

U.S. Pat. Nos. 3,481,174 and 3,482,427 were directed to an arrangement which included a floatable compensator on the bending member which engages the sheet material and as the bending member is swung to bend the sheet pivots so that the contact with the sheet material is maintained.

In U.S. Pat. No. 4,557,132, the sheet bending brake wherein each of the fixed and movable bending members having substantially the entire length of the longitudinal edges thereof formed with longitudinally spaced intermeshing integral projections. The projections on the bending member have a plurality of aligned openings and the projections on the fixed member have a plurality of aligned openings comprising slots extending axially with respect to the longitudinal axis of said member. A hinge pin extends through the openings of said bending member and the slots of the fixed member. The slots have a configuration such that as the bending member is moved relative to the fixed member to bend a workpiece, the hinge pin is guided along said slots such that the contacting portion of the bending member remains substantially in the same position relative to the workpiece.

In U.S. Pat. No. 4,766,757 the sheet bending brake include providing a plurality of links between a handle and the movable jaw which are axially adjustable by the use of two wrenches.

Among the objectives of the present invention are to provide an improved sheet bending brake wherein the clamping force can be more readily adjusted and to provide a sheet bending brake wherein the strength of the bending brake is increased.

In accordance with the invention, a plurality of extensible links are provided between a clamping handle and the movable jaw. Each link is also axially adjustable in length to accommodate the sheet bending brake to workpiece of differing and varying thicknesses and to facilitate locking and unlocking of the sheet material. Each link is readily accessible for adjustment.

More specifically, the sheet bending brake comprises a frame having a fixed jaw and a movable jaw. The fixed jaw defines a clamping surface. The movable jaw has a clamping surface movable between workpiece clamping and non-clamping positions relative to the clamping surface on the fixed jaw. A bending member is hingedly connected to the fixed jaw. A handle is pivoted to the frame. A plurality of axially extensible links are provided. Each link is pivoted at one end to the handle and at the other end to the movable jaw such that in one position of the handle, the links move the movable jaw out of clamping position, and in another position of the handle, the movable jaw is in clamping position. Each link includes an upper block connected to the frame, a shaft extending from the upper block and rotatable therein and threaded into a lower block pivoted to the movable jaw. The shaft has a socket connection in the upper end thereof accessible through an opening in the upper block.

DESCRIPTION OF THE DRAWINGS

FIGS. 4, 5 and 6 are fragmentary view showing the relative positions of the clamping work support surface and anvil member during clamping a workpiece.

FIGS. 7, 8 and 9 are similar fragmentary views showing the relative positions of a prior art sheet bending brake.

DESCRIPTION

Figure 1:
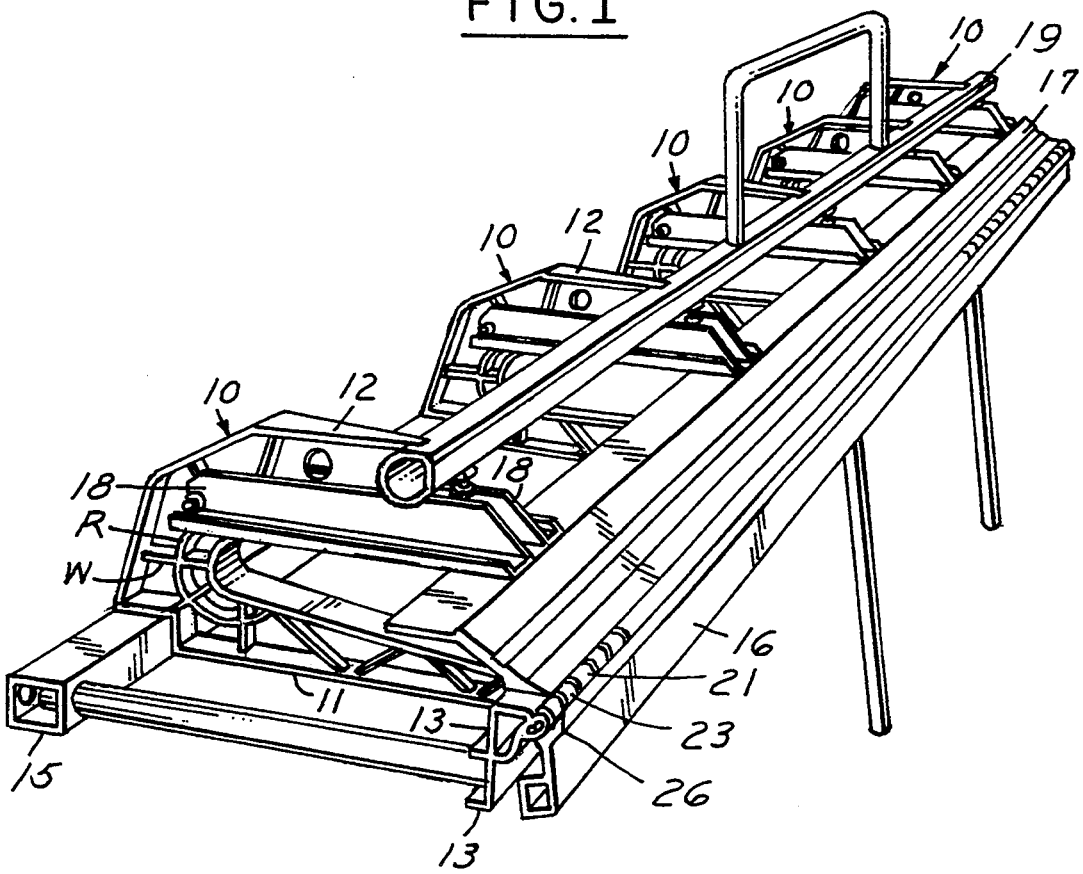
FIG. 1 is a perspective view of a sheet bending brake embodying the invention.
Figure 2A:
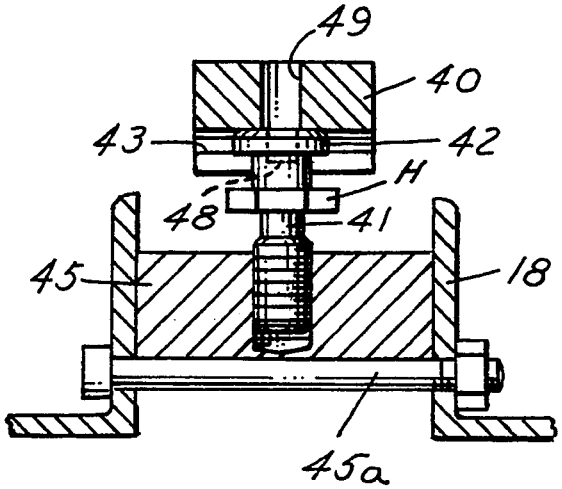
FIG. 2A is a fragmentary sectional view taken along the line 2A—2A in FIG. 2.
Figure 2:
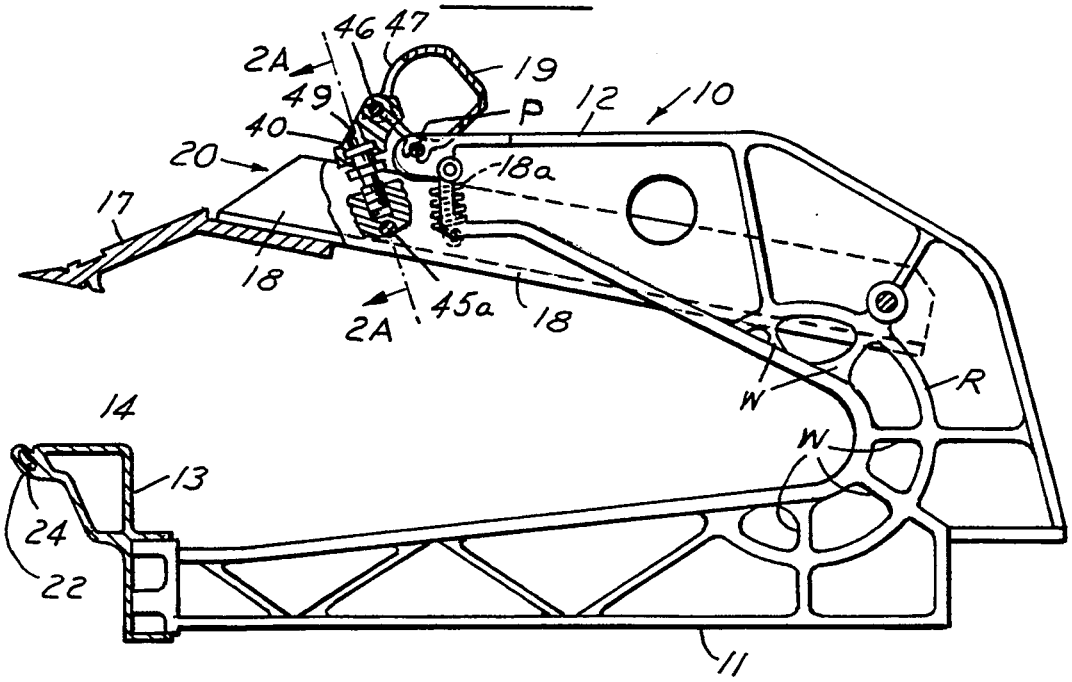
FIG. 2 is a part sectional end view of the sheet bending brake parts being broken away.

Referring to FIGS. 1, 2 and 2A, the sheet bending brake embodying the invention comprises longitudinally spaced C-shaped frame members 10. Each frame member 10 comprises a one-piece body that includes a lower arm 11 and an upper arm 12 which overlies the lower arm 11 in spaced relation thereto. Legs may be provided as needed to support the brake above the floor or working area.

A first fixed member 13 is fixed on the ends of the free lower arms 11 and defines a clamping surface 14. A longitudinally extending base rail 15 is fixed to the rear end of the lower arms 11. A second bending member 16 is hinged to the first member 13, as presently described, to provide a means for bending the sheet material.

A clamping member or anvil 17 extends longitudinally in overlying relationship to the clamping surface 14 of the first member 13. Means are provided for moving the anvil member 17 toward and away from the clamping surface 14 to clamp a workpiece on the clamping surface. The means for clamping the workpiece comprises channel shaped pivot bars 18 provided on each frame member 10 with the clamping member 17 fixed thereto. Pivot bars 18 are pivoted to the frame member 10 adjacent the juncture of the upper arm 12 and lower arm 11. A spring 18*a* extends between a pivot bar 12 and its frame member 10 and urges each bar 18 upwardly. A handle member 19 having a tubular cross section is pivoted to the upper arm 12 of each C-frame member 10 by a pivot pin P. Handle 19 is also pivoted to pivot bars 18 by a plurality of extensible links 20 pivoted at the upper edge of the handle member 20 and at the lower end to the pivot bars 18. The extensible links may be of the general type shown in U.S. Pat. No. 4,766,757, incorporated herein by reference, modified as presently described.

A hinge is provided between the clamping member 14 and bending member 16 and preferably comprises a plurality of longitudinally spaced projections 22 provided at the portion 13 which defines the clamping surface 14. Each projection 22 has a slot 24 formed therein and the slots 24 of the various projections 23 are in longitudinal alignment. Each slot 24 has its lower ends spaced from the clamping surface 14 and extends outwardly and upwardly so that its upper end is generally near the plane of the clamping surface. Each slot 24 is preferably arcuate and has a center spaced from the clamping surface and preferably extends for substantially 90°. A plurality of projections 26 are provided on bending member 16 and a hinge pin extends through holes therein to complete the hinge. Such a construction is shown in U.S. Pat. No. 4,557,132, incorporated herein by reference.

Referring to FIGS. 2 and 10–12, each link 20 comprises an upper block 40, a shaft 41 having an enlarged head 42 which engages a slot 43 in block 40 and is threaded into a lower block 45 that is pivoted between flanges of pivot bar 18 by a pivot pin 45*a*. The upper block 40 is asymmetrical as viewed from the side and is pivoted to handle 19 by a pin 46 extending through an opening or slot 47 in upper arm 12 of the associated C-shaped member 10. The threads of the lower end of shaft 41 or in block 45 are provided with frictional lock means such as a coating or embedded member to resist accidental rotation of shaft 41.

The upper end of shaft 41 is provided with a polygonal socket 48 (FIG. 10) that is accessible through an opening 49 in the head 40 for insertion of a socket wrench S, such as a hexigonal socket wrench.

In order to clamp a workpiece in position for bending, the handle 19 is rotated counterclockwise as viewed in FIGS. 2, 4–6, to move the axis of pivot pin 46 past the plane containing the axis of pivot pin P and pivot pin 45*a*.

Figure 8:
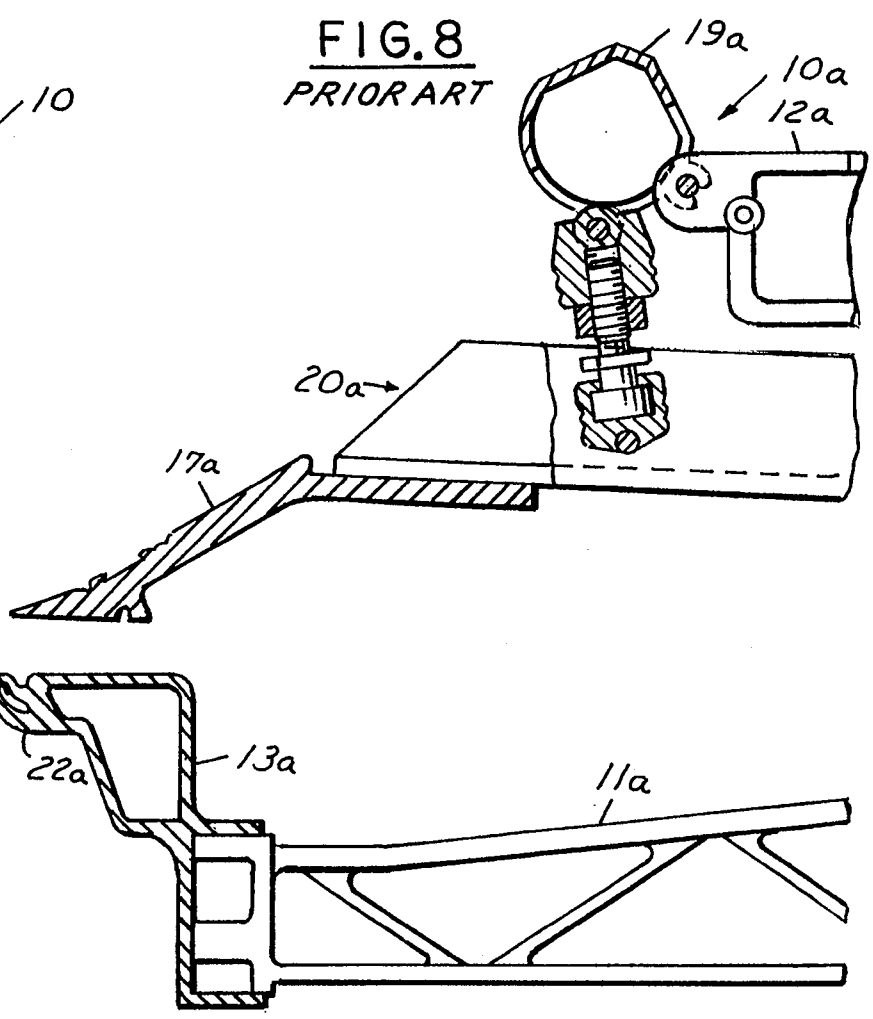
FIG. 8 PRIOR ART

When the sheet bending brake is in fully open position, partially open position or fully clamped position, as viewed in FIGS. 2 and 4–7, the axis of shaft 41 is displaced laterally from the pivot pin 46 so that the opening 49 and socket 48 are readily accessible. This may be contrasted to the prior art shown in FIGS. 7–9 wherein the hex flange H is not accessible by a hex wrench.

Although the invention does not require the use of a hex nut, a hex flange H is provided to give the user an option of using a hex wrench, if desired.

Figures 6, 9:
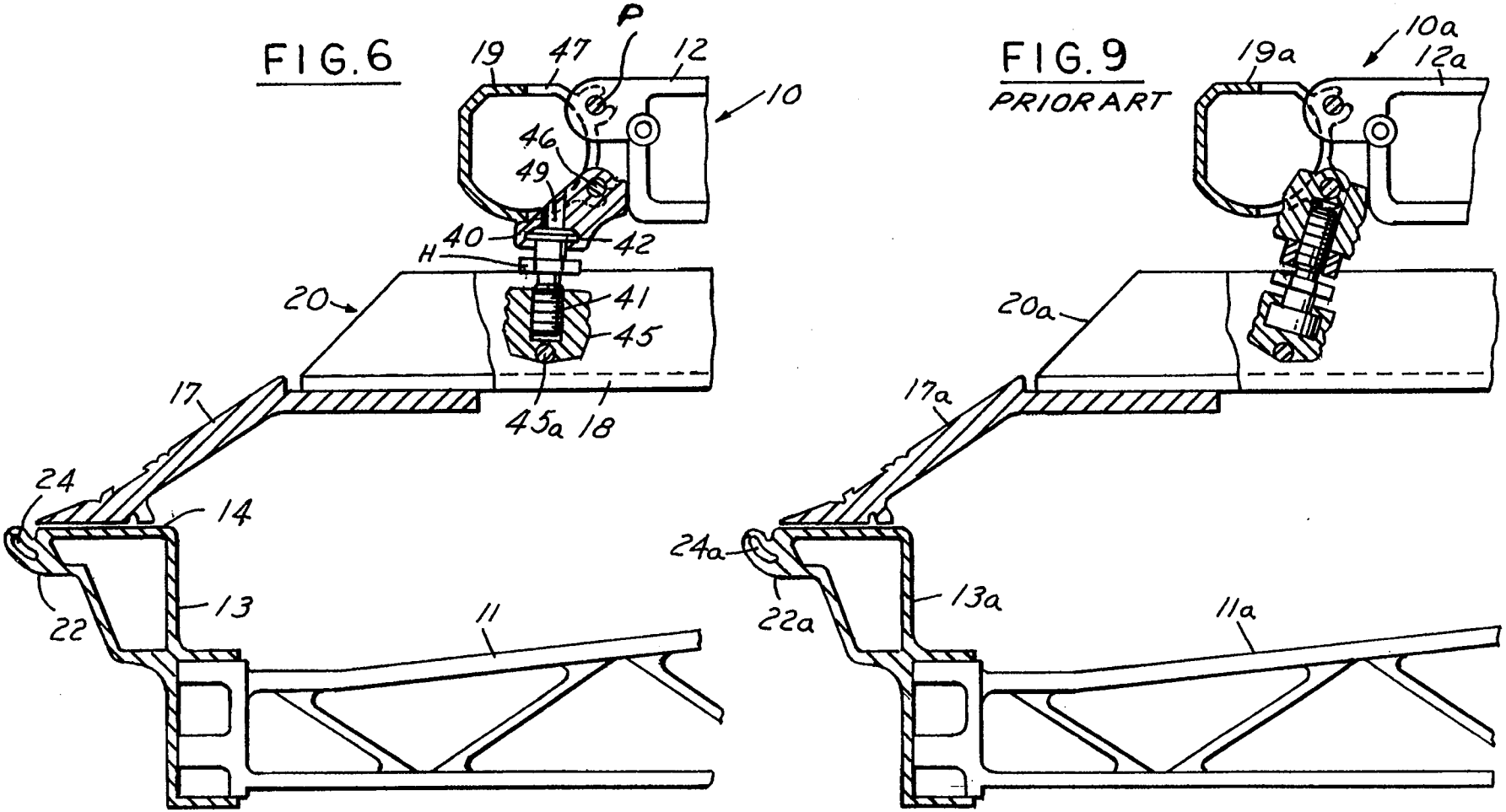
FIG. 9 PRIOR ART
Figure 10:
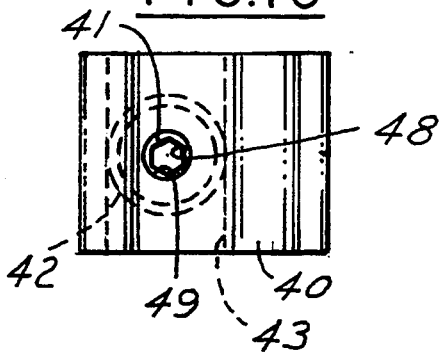
FIG. 10 is a top plan view of a link.
Figure 11:
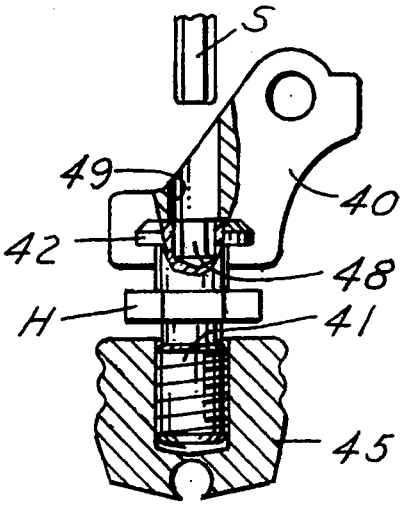
FIG. 11 is a fragmentary part sectional elevational view of a link showing the insertion of a socket wrench.
Figure 12:
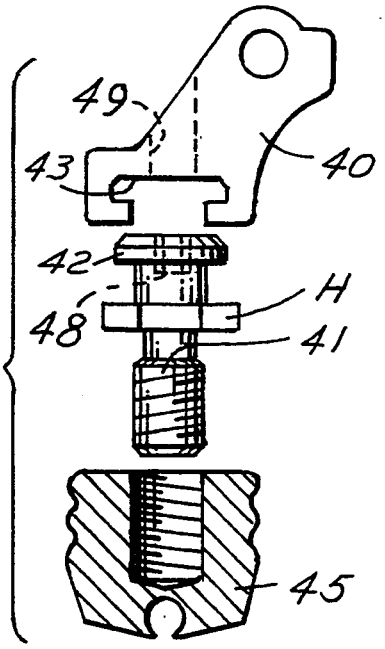
FIG. 12 is a part sectional exploded elevational view of a link.

In the final clamping position as shown in FIG. 6, the axis of the 1 ink 20 is substantially perpendicular to the pivot bar thus maximizing the clamping force on the workpiece.

A further advantage of the present invention is that the length of the shaft 41 can be made shorter. As a result, the opening of the brake is faster, that is, less rotation of the handle is required to open the brake.

Figure 3:
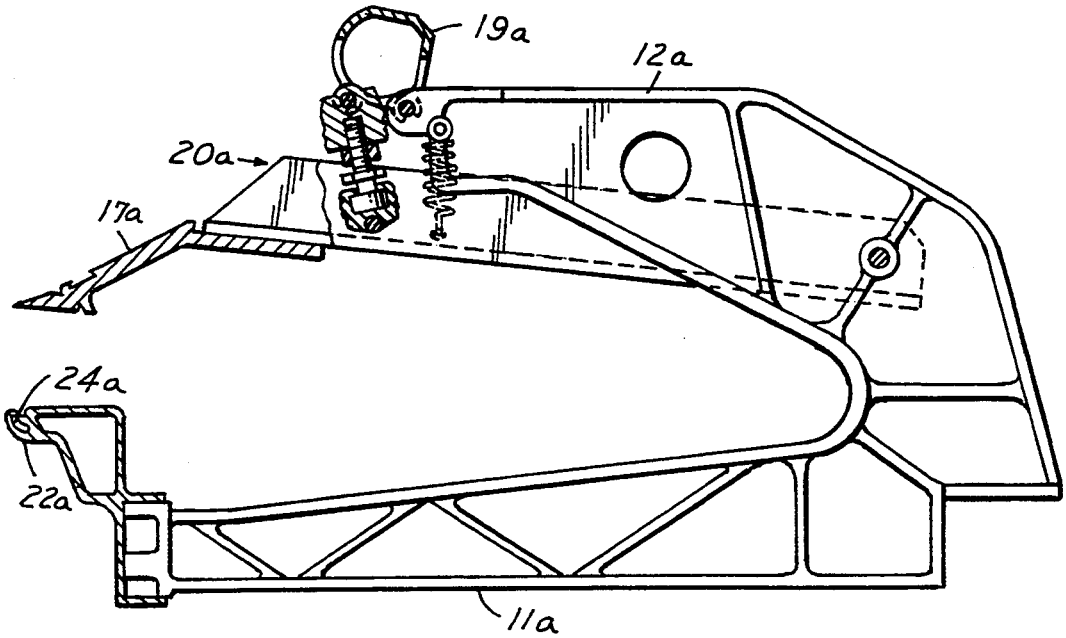
FIG. 3 PRIOR ART
FIG. 3 is a part sectional end view of a prior art bending brake.
Figure 5:
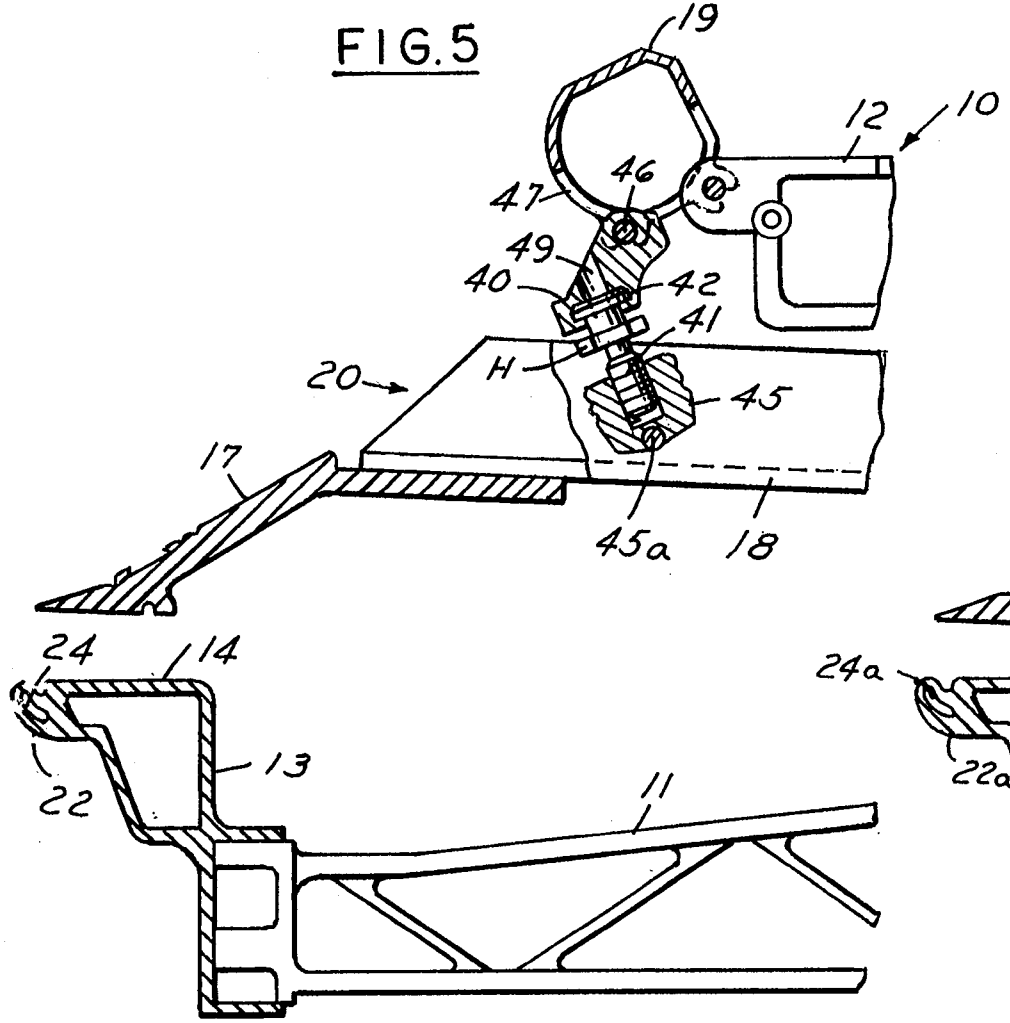

As shown in FIGS. 2 and 4, this construction results in the sheet bending brake having a greater gap between the anvil and the clamping surface when in fully open position than a prior art brake shown in corresponding positions in FIGS. 3, 5 and 9, corresponding parts being shown with the suffix a. The prior art links are like those in the aforementioned U.S. Pat. No. 4,706,757 except they do not utilize a resilient pad.

In accordance with another feature of the invention, the C-shaped frame member is strengthened by an arcuate rib R at the throat of the C-shaped frame member on each side thereof connected by radial webs W extending over 270°. It has been found that such a construction provides sufficient strength that the arms 11, 12 of the frame members 10 may be made longer to accommodate longer workpieces.

It can thus be seen that there has been provided a sheet bending brake wherein the clamping force can be more readily adjusted and to provide a sheet bending brake wherein the strength of the bending brake is increased.

We claim:

1. A sheet bending brake comprising a frame having a fixed jaw and a movable jaw, said fixed jaw defining a clamping surface, said movable jaw having a clamping surface movable between workpiece clamping and non-clamping positions relative to the clamping surface on the fixed jaw, a bending member hingedly connected to the fixed jaw, means for releasably locking the movable jaw in workpiece clamping position comprising a plurality of axially extensible links, a handle pivoted to said frame, each said link being pivoted at one end to said handle and at the other end to said movable jaw such that in one position of said handle, said links move said movable jaw out of clamping position, and in another position of said handle, said movable jaw is in clamping position, each said link including an upper block connected to said frame, said upper block having an upper surface and a lower surface, a shaft extending from said upper block and rotatable therein, a lower block pivoted to said movable jaw, said shaft having an upper end and a lower end, said lower end being threaded into said lower block, said upper end of said shaft being spaced from the upper surface of said upper block such that the upper end is both recessed in said upper block and accessible from said upper surface, said shaft having a socket connection in the upper end thereof accessible through an opening in said upper block for connecting a socket tool.

2. The sheet bending brake set forth in claim 1 wherein said upper block includes an opening through which the block is pivoted to said handle, said opening being displaced laterally from the axis of said opening in said upper block which is aligned with said socket in said shaft.

3. The sheet bending brake set forth in any one of claims 1 and 2 wherein said frame comprises a plurality of C-shaped frame members having upper and lower arms, said handle being pivoted to said upper arms, a pivot member pivoted to each said C-shaped frame member, said movable jaw being fixed on said pivot bars and each said link having the upper body pivoted to said handle and the lower body pivoted to said pivot arm.

4. A sheet bending brake comprising
a frame,
a fixed jaw,
a movable jaw,
said fixed jaw defining a clamping surface,
said movable jaw having a clamping surface movable between workpiece clamping and non-clamping positions relative to the clamping surface on the fixed jaw,
a bending member hingedly connected to the fixed jaw, and
means for releasably locking the movable jaw in workpiece clamping position,
said frame comprising a plurality of C-shaped cast frame members having upper and lower arms joined by an integral throat,
said throat having an inner surface and an outer surface,
said upper arms supporting said movable jaw,
said lower arms supporting said fixed jaw,
each said C-shaped frame member including an integral arcuate rib at said throat spaced radially from said inner and outer surfaces of said throat and radial webs extending radially from said arcuate rib toward said inner and outer surfaces of said throat.

5. The sheet bending brake set forth in claim 4 wherein an arcuate rib and radial ribs are provided on both sides of said throat.

6. The sheet bending brake set forth in claim 5 wherein said means for releasably locking said movable jaw comprises a plurality of axially extensible links,
a handle pivoted to said frame,
each said link being pivoted at one end to said handle and at the other end to said movable jaw such that in one position of said handle, said links move said movable jaw out of clamping position, and in another position of said handle, said movable jaw is in clamping position,
each said link including an upper block connected to said frame, a shaft extending from said upper block and rotatable therein and threaded into a lower block pivoted to said movable jaw,
said shaft having a socket connection in the upper end thereof accessible through an opening in said upper block for connecting a socket tool.

7. The sheet bending brake set forth in claim 6 wherein said upper block includes an opening through which the block is pivoted to said handle, said opening being displaced laterally from the axis of said opening in said upper block which is aligned with said socket in said shaft.

8. The sheet bending brake set forth in claim 7 wherein said handle is pivoted to said upper arms, a pivot member pivoted to each said C-shaped frame member, said movable jaw being fixed on said pivot bars and each said link having the upper body pivoted to said handle and the lower body pivoted to said pivot arm.

9. A sheet bending brake comprising
a frame having a fixed jaw and a movable jaw,
said fixed jaw defining a clamping surface,
said movable jaw having a clamping surface movable between workpiece clamping and non-clamping positions relative to the clamping surface on the fixed jaw,
a bending member hingedly connected to the fixed jaw,
means for releasably locking the movable jaw in workpiece clamping position comprising
a plurality of axially extensible links,
a handle pivoted to said frame,
each said link being pivoted at one end to said handle and at the other end to said movable jaw such that in one position of said handle, said links move said movable jaw out of clamping position, and in another position of said handle, said movable jaw is in clamping position,
each said link including an upper block connected to said frame, a shaft extending from said upper block and rotatable therein and threaded into a lower block pivoted to said movable jaw,
said shaft having a socket connection in the upper end thereof accessible through an opening in said upper block for connecting a socket tool,
said upper block including an opening through which the block is pivoted to said handle, said opening being displaced laterally from the axis of said opening in said upper block which is aligned with said socket in said shaft.

10. The sheet bending brake set forth in claim 9 wherein said frame comprises a plurality of C-shaped frame members having upper and lower arms, said handle being pivoted to said upper arms, a pivot member pivoted to each said C-shaped frame member, said movable jaw being fixed on said pivot bars and each said link having the upper body pivoted to said handle and the lower body pivoted to said pivot arm.

11. A sheet bending brake comprising
a frame,
a fixed jaw,
a movable jaw,
said fixed jaw defining a clamping surface,
said movable jaw having a clamping surface movable between workpiece clamping and non-clamping positions relative to the clamping surface on the fixed jaw,
a bending member hingedly connected to the fixed jaw, and
means for releasably locking the movable jaw in workpiece clamping position,
said frame comprising a plurality of C-shaped cast frame members having upper and lower arms joined by an integral throat,
said upper arms supporting said movable jaw,
said lower arms supporting said fixed jaw,
each said C-shaped frame member including an integral arcuate rib at said throat and radial webs extending therefrom,
an arcuate rib and radial ribs being provided on both sides of said throat,
said means for releasably locking said movable jaw comprising a plurality of axially extensible links,
a handle pivoted to said frame,
each said link being pivoted at one end to said handle and at the other end to said movable jaw such that in one position of said handle, said links move said movable jaw out of clamping position, and in another position of said handle, said movable jaw is in clamping position,
each said link including an upper block connected to said frame, a shaft extending from said upper block and rotatable therein and threaded into a lower block pivoted to said movable jaw, said shaft having a socket connection in the upper end thereof accessible through an opening in said upper block for connecting a socket tool, said upper block including an opening through which the block is pivoted to said handle, said opening being displaced laterally from the axis of said opening in said upper block which is aligned with said socket in said shaft.

12. The sheet bending brake set forth in claim 11 wherein said handle is pivoted to said upper arms, a pivot member pivoted to each said C-shaped frame member, said movable jaw being fixed on said pivot bars and each said link having the upper body pivoted to said handle and the lower body pivoted to said pivot arm.

* * * * *